US009121665B2

(12) United States Patent
Hinds

(10) Patent No.: US 9,121,665 B2
(45) Date of Patent: Sep. 1, 2015

(54) GUN WITH INTERNALLY STORED BIPOD AND MONOPOD

(76) Inventor: Richard A. Hinds, West Columbia, SC (US)

( * ) Notice: Subject to any disclaimer, the term of this patent is extended or adjusted under 35 U.S.C. 154(b) by 117 days.

(21) Appl. No.: 13/810,446

(22) PCT Filed: Jul. 13, 2011

(86) PCT No.: PCT/US2011/043839

§ 371 (c)(1),
(2), (4) Date: Jan. 15, 2013

(87) PCT Pub. No.: WO2012/009427

PCT Pub. Date: Jan. 19, 2012

(65) Prior Publication Data

US 2013/0174463 A1 Jul. 11, 2013

Related U.S. Application Data

(60) Provisional application No. 61/364,592, filed on Jul. 15, 2010.

(51) Int. Cl.

| | |
|---|---|
| ***F41A 23/10*** | (2006.01) |
| ***F41C 23/16*** | (2006.01) |
| ***F41C 27/22*** | (2006.01) |

(Continued)

(52) U.S. Cl.

CPC ..... *F41C 27/22* (2013.01); *F41A 23/04* (2013.01); *F41A 23/10* (2013.01); *F41C 23/16* (2013.01); *F41C 23/22* (2013.01)

(58) Field of Classification Search

CPC ..... F41C 23/12; F41C 23/16; F41C 23/22; F41C 27/00; F41C 27/22; F41A 11/04; F41A 23/04; F41A 23/06; F41A 23/08; F41A 23/10

USPC ..... 42/73, 90, 94; 89/1.42

See application file for complete search history.

(56) References Cited

U.S. PATENT DOCUMENTS

| | | | | |
|---|---|---|---|---|
| 4,625,620 | A * | 12/1986 | Harris | 89/37.04 |
| 4,776,124 | A * | 10/1988 | Clifton | 42/94 |
| 4,776,124 | B1 | 10/1988 | Clifton | |

(Continued)

FOREIGN PATENT DOCUMENTS

WO WO 2009009663 A2 * 1/2009 ..... F41A 23/10

OTHER PUBLICATIONS

Jae Seob Han, International Search Report and Written Opinion, Apr. 6, 2012, ISA/KR, Republic of Korea.

*Primary Examiner* — Bret Hayes
*Assistant Examiner* — Derrick Morgan
(74) *Attorney, Agent, or Firm* — Michael A. Mann; Nexsen Pruet, LLC

(57) ABSTRACT

A firearm stock having a bipod on the end of the fore-stock with legs that store in channels formed inside the fore-stock and which permits the canting movement of the deployed bipod with respect to the stock. The bipod legs are pulled from their stored positions to extended positions and then pivoted to their splayed and deployed positions perpendicular to the axis of the stock. The stock also pivotally and optionally carries a monopod in the underside of the butt stock for pivoting rearward to its deployed position, urged by a spring into both the deployed and stored positions. The bipod legs may telescope and are exchangeable with different types of legs; the monopod is extendable and may be stored in its extended position against the underside of the butt stock.

19 Claims, 10 Drawing Sheets

(51) Int. Cl.
*F41A 23/04* (2006.01)
*F41C 23/22* (2006.01)

(56) References Cited

U.S. PATENT DOCUMENTS

| | | | | |
|---|---|---|---|---|
| 5,029,407 | A * | 7/1991 | Kirkpatrick | 42/94 |
| 5,074,188 | A * | 12/1991 | Harris | 89/37.04 |
| 5,711,103 | A * | 1/1998 | Keng | 42/94 |
| 6,289,622 | B1 * | 9/2001 | Desch et al. | 42/94 |
| 6,305,116 | B1 | 10/2001 | Parker | |
| 7,100,318 | B1 * | 9/2006 | Beltz | 42/94 |
| 7,428,794 | B2 * | 9/2008 | Oz | 42/73 |
| 7,610,711 | B2 * | 11/2009 | Oz | 42/94 |
| 7,614,174 | B1 * | 11/2009 | Beltz | 42/94 |
| 7,676,977 | B1 * | 3/2010 | Cahill et al. | 42/94 |
| 7,856,748 | B1 * | 12/2010 | Mertz | 42/94 |
| 8,458,946 | B1 * | 6/2013 | Pintsch | 42/94 |
| 2002/0074467 | A1 * | 6/2002 | Harris | 248/188.9 |
| 2007/0011932 | A1 * | 1/2007 | Oz | 42/94 |
| 2008/0307689 | A1 * | 12/2008 | Dotson | 42/94 |
| 2009/0000175 | A1 * | 1/2009 | Potterfield et al. | 42/94 |
| 2010/0005696 | A1 | 1/2010 | Moody | |
| 2011/0247256 | A1 * | 10/2011 | Lickteig | 42/94 |
| 2012/0266513 | A1 * | 10/2012 | Gnesda et al. | 42/72 |
| 2013/0232844 | A1 * | 9/2013 | Gallo | 42/94 |
| 2014/0115940 | A1 * | 5/2014 | Bonelli et al. | 42/94 |

* cited by examiner

GUN WITH INTERNALLY STORED BIPOD AND MONOPOD

PRIORITY CLAIM

Priority is claimed to U.S. provisional patent application Ser. No. 61/364,592, filed Jul. 15, 2010, which is incorporated herein in its entirety.

RELATED APPLICATIONS

The present application is related to U.S. non-provisional patent application Ser. No. 12/668,417, filed Jan. 9, 2010, which claims priority to PCT US08/69650, which in turn claims priority to US provisional patent application Ser. No. 60/949,118 filed Jul. 11, 2007; and to US non-provisional patent application Ser. No. 13/149,449 filed Jul. 6, 2011, which claims priority to PCT US 2010/20194, which claims priority to US provisional patent application Ser. No. 61/143,026 filed Jan. 7, 2009. These related applications are incorporated herein by reference in their entirety.

BACKGROUND OF THE INVENTION

The present invention relates to monopods, bipods, tripods and aiming sticks used in connection with guns.

Marksmanship with a gun, particularly at long range, is improved by using a bipod, tripod or aiming stick. These devices support the barrel end of the gun and eliminate some or most of the motion of the barrel. This motion can come, for example, from the heartbeat of the marksman or the pull of the trigger.

The typical bipod is mounted to the barrel or fore-end of the gun and has two positions, a stored position with the two legs folded approximately parallel to and against the fore-end and an in-use position with the two legs unfolded, approximately perpendicular to the fore-end, and splayed to provide triangular support for the fore-end at the apex of the triangle so formed. Many of these types of bipods have telescoping legs so they can be ground-engaging regardless of whether the marksman is prone, kneeling or standing.

A tri-pod improves stability over use of a bipod by placing the fore-end at the apex of a tetrahedron. An aiming stick has one leg and eliminates some of the unwanted motion of the barrel as it is aimed and is significantly simpler to manufacture, use and carry than a bipod or tripod.

Bipods work well for the most part but must be rugged so that they do not become bent or broken if the user falls or inadvertently bumps the bipod against a tree or rock. They must also be rust- and corrosion-resistant, and, if part of a military or hunting gun, be capable of taking on camouflage paint. Bipods require frequent cleaning so that they are free of dust, dirt and snagged vegetation, particularly in the case of military use. Rust and dirt make bipods harder to operate.

Thus there remains a need for a more convenient, less troublesome bipod, tripod or aiming stick for use with a gun.

SUMMARY OF THE INVENTION

According to its major aspects and briefly recited, the present invention is a gun resting system incorporated into a gun stock wherein the forward portion of the stock, or fore-stock, is formed to have channels therein that are dimensioned to receive the legs of a gun rest, such as the legs of a bipod, when the bipod legs are in their stored positions. The gun also has a monopod rearward of the bipod and stored in a recess formed in the underside of the butt stock. To deploy the bipod legs, the ends of the legs, that is, their "feet," are pulled parallel to the barrel and towards the muzzle end of the firearm to bring the legs to an extended position, at which point they are clear of the channels in the fore-stock. From their extended positions, the legs can be pivoted down and apart into a splayed, deployed position approximately perpendicular to the gun barrel. To return the bipod legs from their deployed positions to their stored positions, they are pivoted up and together, parallel to the barrel and to each other, and then pushed back into their respective channels in the fore-stock.

The monopod is pivotally attached to the butt stock and pivots forward into a recess formed in the butt stock when not in use. The monopod can be extended to increase its length to suit the marksman by unscrewing its foot, and then used or stored in the adjusted position if desired.

The use of the fore-stock as a storage place for bipod legs is an important feature of the present invention. Storing the bipod when not in use in the fore-stock keeps the bipod legs cleaner, avoids damaging them and having them catch on foreign objects, keeps the weight of the firearm closer to the centerline of the gun, makes the gun easier to transport, and keeps the bipod legs out of the way when not in use, giving the gun a trimmer appearance.

The use of a monopod in the rear portion of the stock is another feature of the invention, particularly in combination with the bipod. The monopod in combination with the bipod provides three-point stance for great stability.

In addition, the use of the fore-stock for bipod storage makes better use of an existing structure of the gun than otherwise and enables the bipod to be more securely affixed to the gun without attaching a removable bipod to the barrel, which would adversely affect the barrel's performance characteristics, or to the fore-stock, which would mar the fore-stock.

These and other features and their advantages will be apparent to those skilled in the art of firearm and firearm accessory design from a careful reading of the Detailed Description of Embodiments accompanied by the following drawings.

DETAILED DESCRIPTION OF THE INVENTION

The present invention is a gun resting system, a gun with the gun resting system, a stock with the gun resting system, and a method for incorporating the gun resting system into the stock of a gun.

Figure 1:
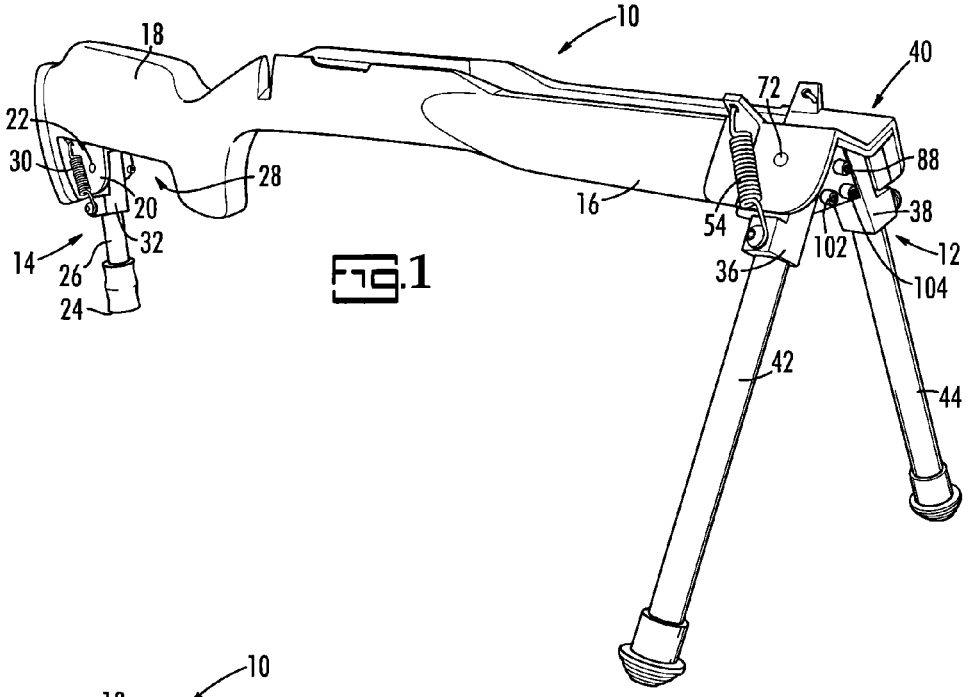
FIG. 1 is a perspective view of a stock with the present bipod and monopod shown in the deployed positions, according to an embodiment of the invention.
Figure 2:
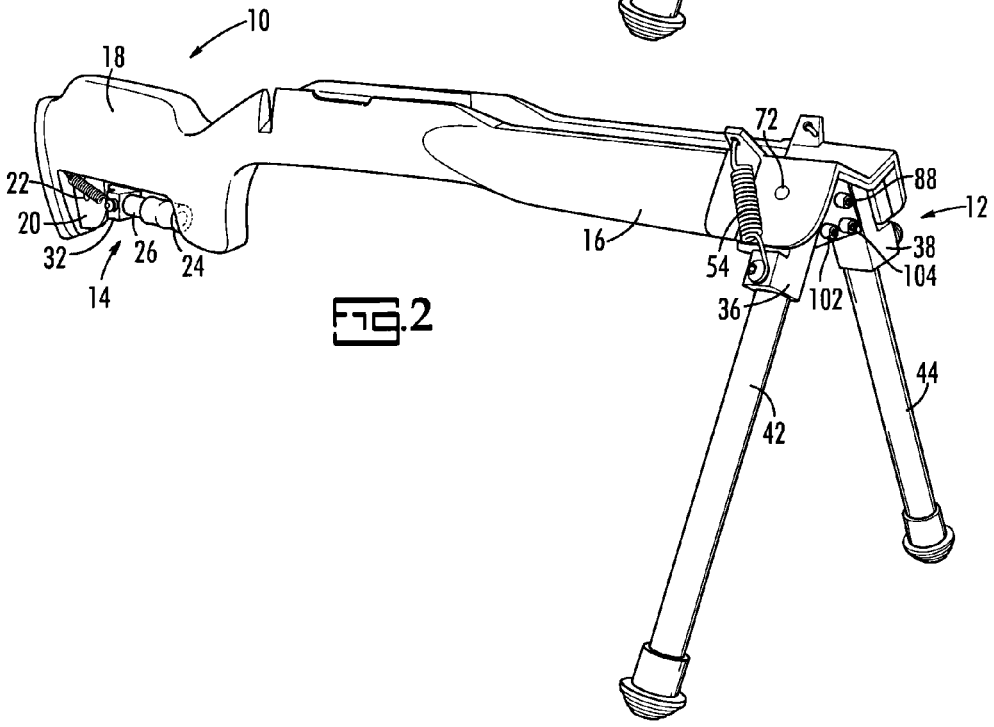
FIG. 2 is a perspective view of the stock of FIG. 1 with the monopod moved to the stored position from the deployed position, according to an embodiment of the invention.

The term "gun" will refer herein to any firearm having a butt stock and a fore-stock, which may be integrally formed as a unitary stock, as shown in FIG. 1 or formed separately. A typical firearm will also have a receiver, a trigger assembly operatively connected to the receiver, and a barrel also operatively connected to the receiver. The barrel typically rests on the fore-stock and the butt stock is attached to the receiver. In a unitary stock, as shown, the receiver fits within the stock between its fore-stock and the butt stock. The trigger causes the receiver to fire a round of ammunition resulting in a projectile such as a bullet passing through the barrel. Accordingly, the term firearm can include almost all small arms ranging from pistols to rifles to machine guns. The term fore-stock refers to the portion of the stock that supports the barrel and is used to hold the distal or forward portion of the firearm with the non-trigger-engaging hand. The butt stock is used for holding the firearm, and in particular by placing the butt stock against the shoulder of the user.

FIGS. 1-8 illustrate the deployment and storage of the monopod and bipod by the user beginning with both of them in the deployed positions and ending with both in the stored positions. FIG. 1 is a perspective view of a stock 10 with the present bipod 12 and monopod 14 shown in the deployed positions, providing a three-point stance for stability. Bipod 12 is attached to the end of fore-stock 16; monopod is attached to the underside of butt stock 18. FIG. 2 again shows stock 10 but with monopod 14 held to butt stock 18 by a bracket 20 and movable to the stored position by rotating it about a rear pivot pin 22 with a horizontal axis perpendicular to the long dimension of stock 10 so the foot 24 of monopod 14 can rotate forward into a recess 28 formed in the underside of butt stock 18. By "recess" it is meant that the normal contours of the underside of a butt stock will be trimmed to make room for monopod 14 within those contours so that the envelope defined by the normal contours will be preserved and no part of monopod 14 extends significantly beyond them. Monopod 14 will then be stored against the underside of butt stock 18 pivoted from its deployed position where it was roughly perpendicular to butt stock 18 (best seen in FIGS. 7 and 8). The length of monopod 14 may be adjusted to raise or lower butt stock 18 when it rests on monopod simply by rotating a foot 24 carried on the end of a threaded rod 26 about an axis parallel to the long dimension of monopod 14, thereby unscrewing foot 24 from or screwing foot 24 into monopod 14 depending on the direction of rotation of foot 24. Monopod 14 may be stored in recess 28 in butt stock 18 in an extended position, as the user prefers, as recess 28 may be large enough to accommodate monopod 14 even when foot 24 is extended to its maximum length. A spring 30 attached to bracket 20 and to collar 32 on rod 26 urges monopod 14 to return to both its stored position parallel to and against the underside of butt stock 18 (FIG. 2) and its deployed position perpendicular to butt stock 18 (FIG. 1), and helps to hold them in those extreme positions.

Figure 3:
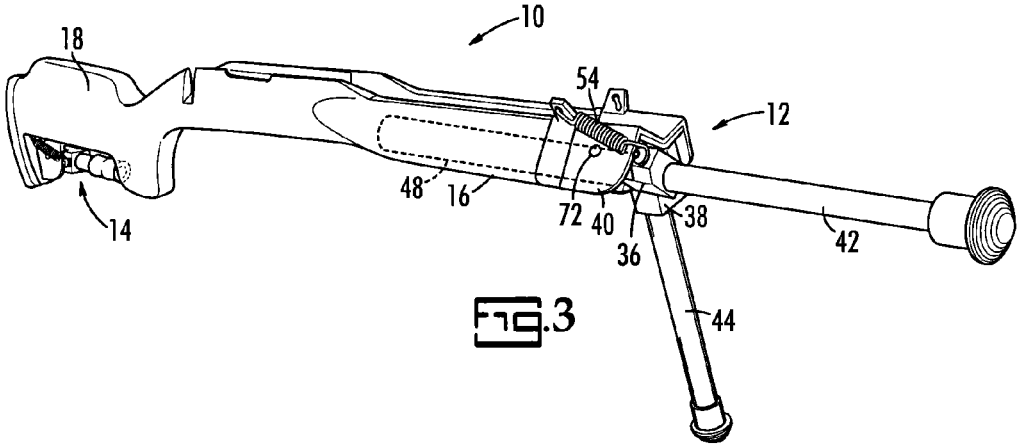
FIG. 3 is a perspective view of the stock of FIG. 2 with one leg of the bipod moved from the deployed position to the extended position in preparation for storage.
Figure 4:
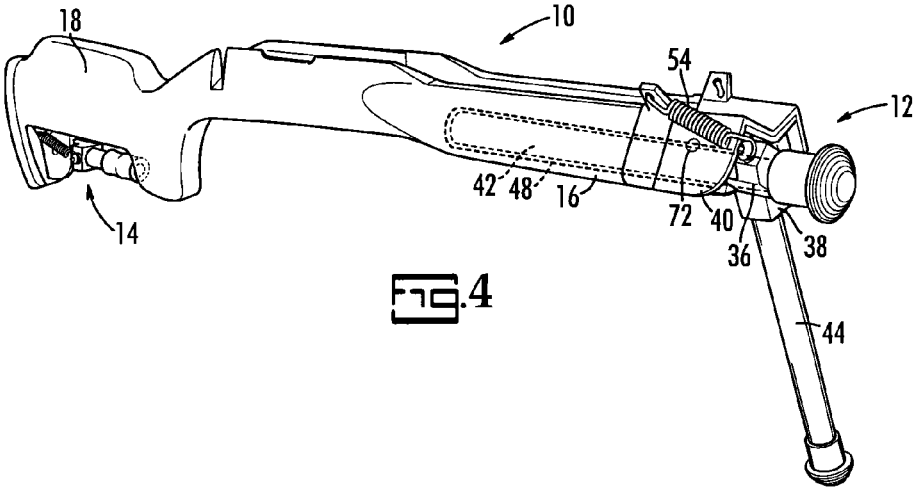
FIG. 4 is a perspective view of the stock of FIG. 3 with one leg of the bipod moved from the extended position to the stored position in the fore-stock, according to an embodiment of the invention.
Figure 5:
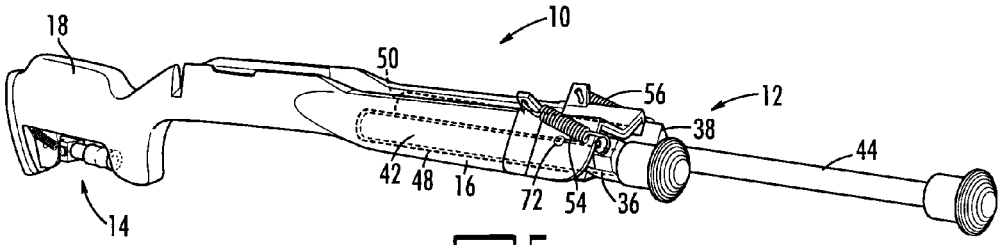
FIG. 5 is a perspective view of the stock of FIG. 4 with the other leg of the bipod moved from the deployed position to the extended position, according to an embodiment of the invention.
Figure 6A:
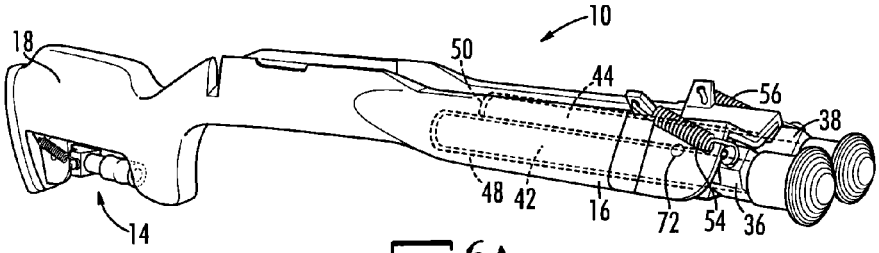
FIG. 6A is a perspective view of the stock of FIG. 5 with the other leg of the bipod moved from the extended position to the stored position in the fore-stock, according to an embodiment of the invention.
Figure 6B:
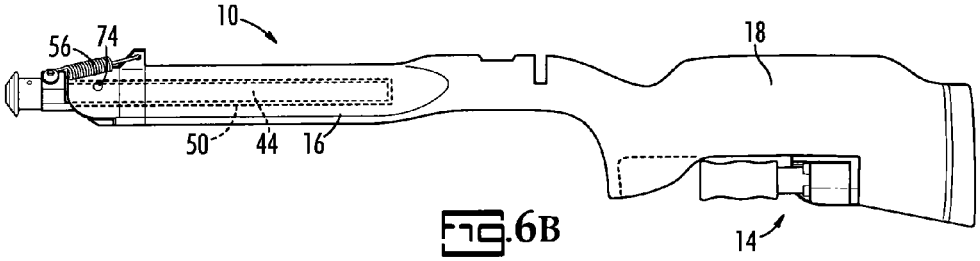
FIG. 6B is a side view of the left side of the stock of FIG. 6A, according to an embodiment of the invention.

Referring now to FIGS. 3-6B, bipod 12 includes a bracket 40 that is attached to the end of fore-stock 16 and holds two legs 42, 44 pivotable about pivot pins 72 (FIGS. 1-6), 74 (FIG. 6B). Two parallel channels 48, 50, (see FIGS. 6A and 6B, with channels 48, 50, shown in ghost) are formed in fore-stock 16 and that are dimensioned to receive bipod legs 42, 44, when legs 42, 44, are moved into their stored positions from their extended positions. Channels 48, 50, are in registration with a pair of holes 60, 62, formed in bracket 40 through which legs 42, 44, pass when being slid into channels 48, 50. FIG. 3 shows fore-stock 16 in a perspective view with leg 42 of bipod 12 moved from the deployed position (FIG. 2) to the extended position (FIG. 3) by pivoting leg 42 from the deployed position where it is oriented at approximately right angles with respect to fore-stock 16 to the extended position where leg 42 is parallel to fore-stock 16, aided by a spring 54 stretched from bracket 40 to a collar 36 on pivoted leg 42. In the extended position, legs 42, 44, are now aligned with holes 60, 62, (see FIGS. 9-13) in bracket 40 and with channels 48, 50, formed in fore-stock 16. From there, by comparing FIG. 4 to FIG. 3, one can see that leg 42 of bipod 12 is moved from the extended position (FIG. 3) to a stored position (FIG. 4) inside channel 48 of fore-stock 16 by sliding leg 42 through hole 60 in bracket 40 into the corresponding channel 48 for leg 42.

FIG. 5 is a perspective view of stock 10 of FIG. 4 with leg 44 of bipod 12 pivoted from a deployed position (FIG. 4) to an extended position (FIG. 5), as assisted by spring 56 on a side of bracket 40 opposite the side spring 54 is on. In FIGS. 6A and 6B, leg 44 of bipod 12 is shown moved from the extended position (FIG. 5) to a stored position (FIGS. 6A and 6B) by pushing it through hole 62 (as best seen in FIGS. 9-13) in bracket 40 into its corresponding channel 50 in fore-stock 16. Note that as both legs 42, 44, pivot from the extended position (FIGS. 3 and 5) to the deployed position (FIG. 1), they move from being parallel to each other to being at an angle with respect to each other, or, in other words, splayed.

Figure 7:
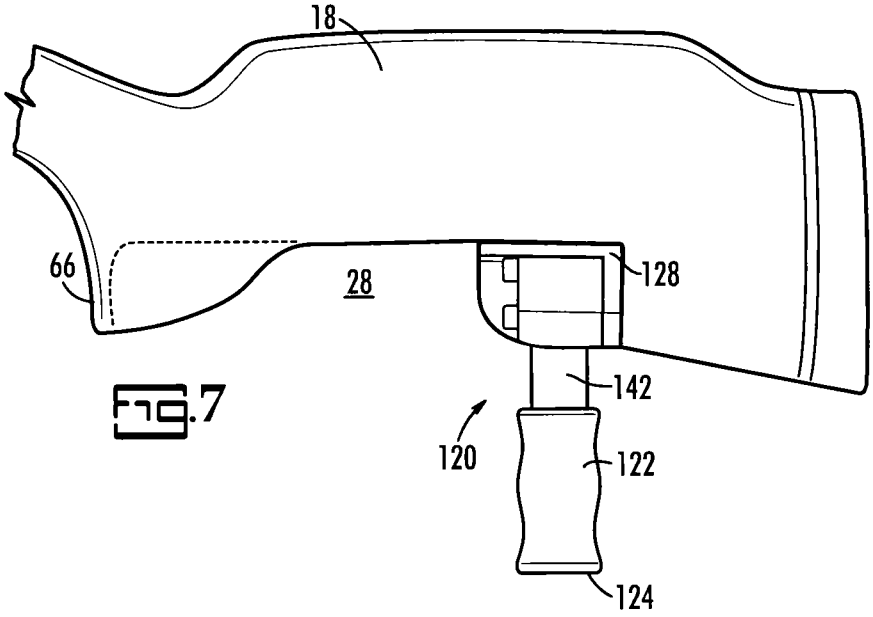
FIG. 7 is a left side view of the butt stock showing the monopod in the deployed position, according to an embodiment of the invention.
Figure 8:
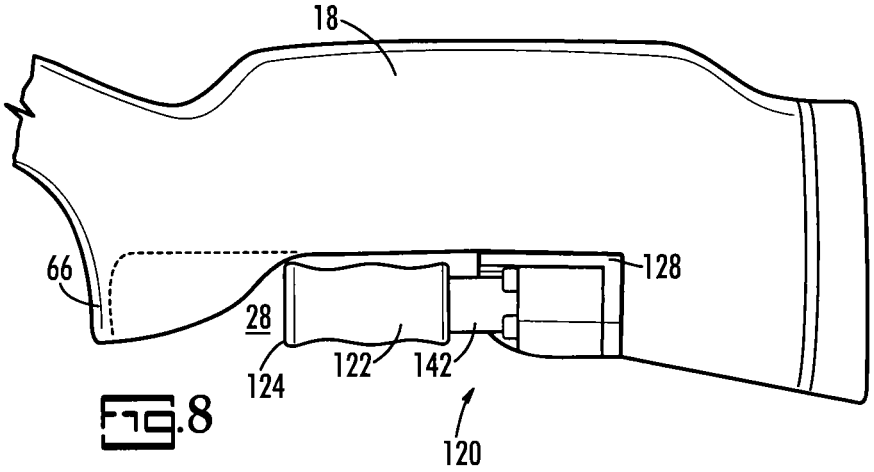
FIG. 8 is a left side view of the butt stock showing the monopod in the stored position, according to an embodiment of the invention.
Figure 14A:
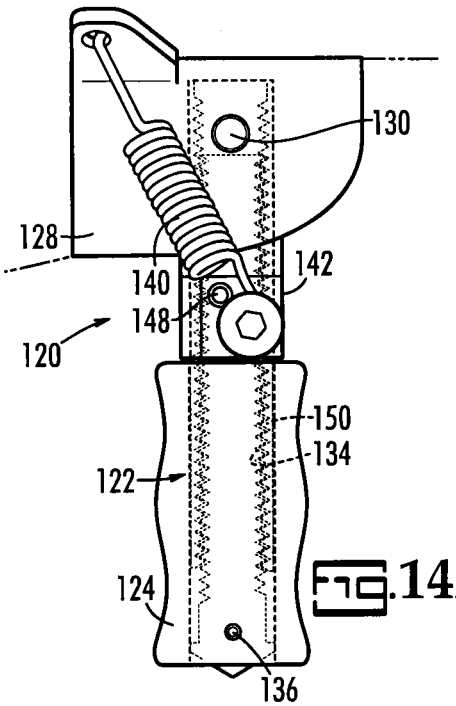
FIGS. 14A and 14B illustrate side, partially cut-away, cross sectional views of an alternative view of the monopod in the retracted position (FIG. 14A) and the extended position (FIG. 14B), according to an embodiment of the invention.
Figure 14B:
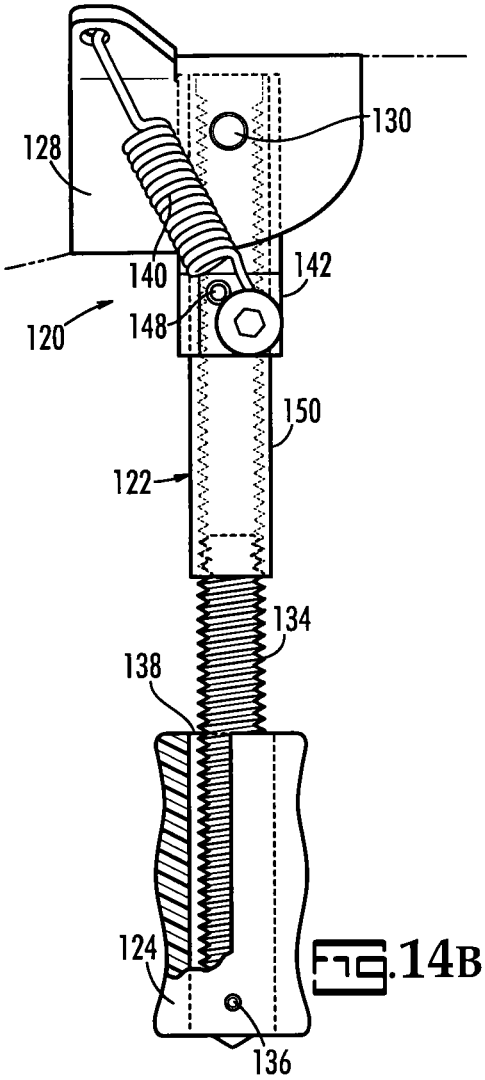

FIGS. 7, 8, 14A and 14B illustrate a different embodiment of a monopod 120 with a leg 122 terminating in a grip 124. FIGS. 7 and 8 show monopod 120 from the left side; FIGS. 14A and 14B show monopod 120 from the right side. Leg 122 is held in collar 142 by set screw 148. A threaded shaft 134 runs from inside bracket 128 through grip 124 to which threaded shaft 134 is pinned by a pin 136. An annular gap 138 exists (FIG. 14B) between the inside of the axial hole formed in grip 124 and the exterior of treaded shaft 134 A spring 140 connects bracket 128 to a collar 142 and urges leg 122 to the stored position (see FIG. 1) and to the deployed position (as seen in both FIGS. 14A and 14B). A set screw 148 is used to secure tube 150 to collar 142.

When threaded shaft 134 is fully threaded into tube 150, the top of grip 124 is seated against the bottom of collar 142. When threaded shaft is nearly removed from tube 150, the bottom of grip 124 is at least 5 centimeters (2 inches) and up to 7.5 centimeters (3 inches) extended. Bracket 128 is fastened to butt stock 18 by screws or other convenient means.

Monopod 14 is attached to the underside of butt stock 18, within recess 28, using a bracket 128 that allows monopod 14 to pivot into and out of recess 28. By gripping monopod 14 with the user's fingers, it can be pivoted counter-clockwise when viewed from the left side (FIGS. 7 and 8) from the stored position in recess 28 to the in-use position. Note that recess 28 provides sufficient length including a hollow portion formed in hand grip 66 so that monopod 14 can be stored in an extended configuration.

Figure 9:
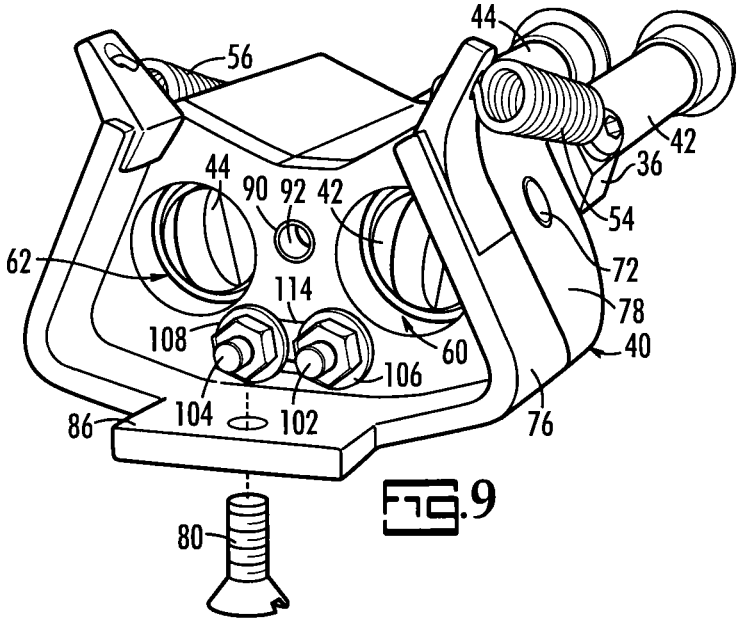
FIG. 9 is a right rear perspective view of the bipod with both legs in the extended positions and the fore-stock removed, according to an embodiment of the invention.
Figure 10:
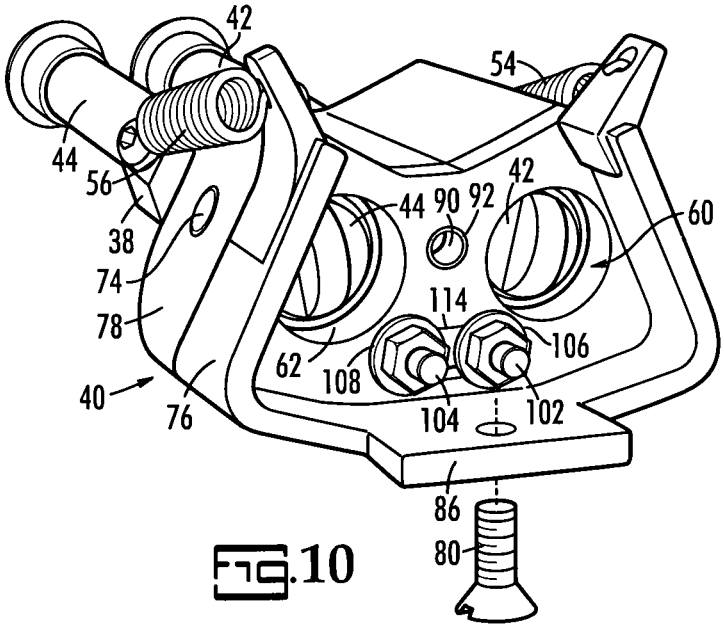
FIG. 10 is a left rear perspective view of the bipod with both legs in the extended positions and the bipod shown removed from the stock, according to an embodiment of the invention.

FIGS. 9 and 10 are right rear and left rear perspective views of bracket 40 of bipod 12 with both legs 42, 44, in their respective extended positions and bracket 40 shown removed from fore-stock 18 so that bracket 40 can be seen from the rear. Note the springs 54, 56, run from the sides of bracket 40 to collars 36, 38, on legs 42, 44, to urge legs 42, 44, into either the stored position or the deployed position from the extended position, as legs 42, 44, respectively, are pivoted about pivot pins 72, 74, from their extended positions to their deployed positions. Note also that legs 42, 44, are pushed through holes 60, 62 in bracket 40 as they are moved from the extended position to the stored position into channels 48, 50, formed in fore-stock 16.

Bracket 40 has two parts. A first part 76 of bracket 40 is made to receive the end of fore-stock 16 and be fastened directly to it, and a second part 78 of bracket 40 holds collars 36, 38. First part 76 is fastened to fore stock 16 from below by a screw 80 through a hole in a tang 86 formed as part of first part 76 and which fits into a recess (not shown) formed in the underside of fore stock 16. First part 76 is fastened to the end of fore-stock 16 by a screw 88 that passes through a sleeve 90 fitted into a hole 92 in first and second parts 76, 78, and then be driven into the end of fore-stock 16. Sleeve 90 serves to maintain the alignment of first and second parts 76, 78.

The second part 78 of bracket 40 holds pivoting collars 36, 38, which encircle the bipod legs 42, 44. Legs 42, 44, slide freely within collars 36, 38, but a right set screw (not shown) and a left set screw 98, (best seen in FIG. 16) preferably tipped in nylon, allow the user to adjust the ease of sliding. After a while, both left set screw and right set screw 98, may need to be tightened. Collars 36, 38, are pivotable with respect to second part 78 of bracket 40 about pivot pins 72, 74, which control and limit movement of legs 42, 44, from their splayed, deployed positions to their parallel, extended positions but also the registration of legs 42, 44, with holes 60, 62, of bracket 40 and movement of legs 42, 44, in sliding from their extended positions to their stored positions through those holes 60, 62. The dividing line between first part 76 and second part 78 can be seen in FIGS. 9 and 10 on the opposing sides of bracket 40.

Figure 11:
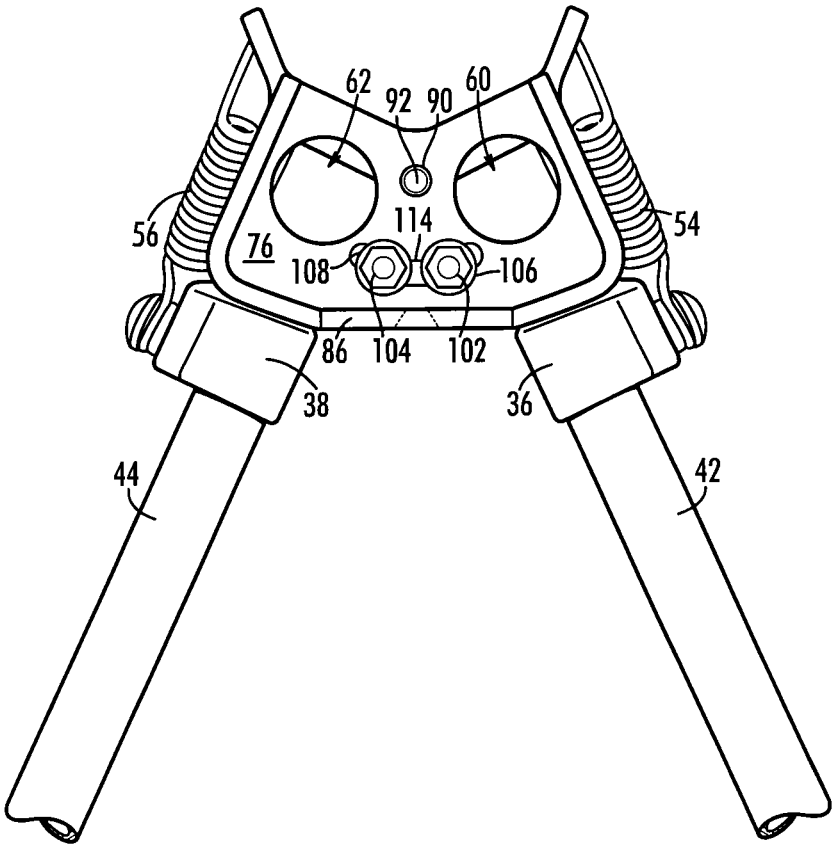
FIG. 11 is a rear view of the bipod with both legs in the deployed position, according to an embodiment of the invention.
Figure 12:
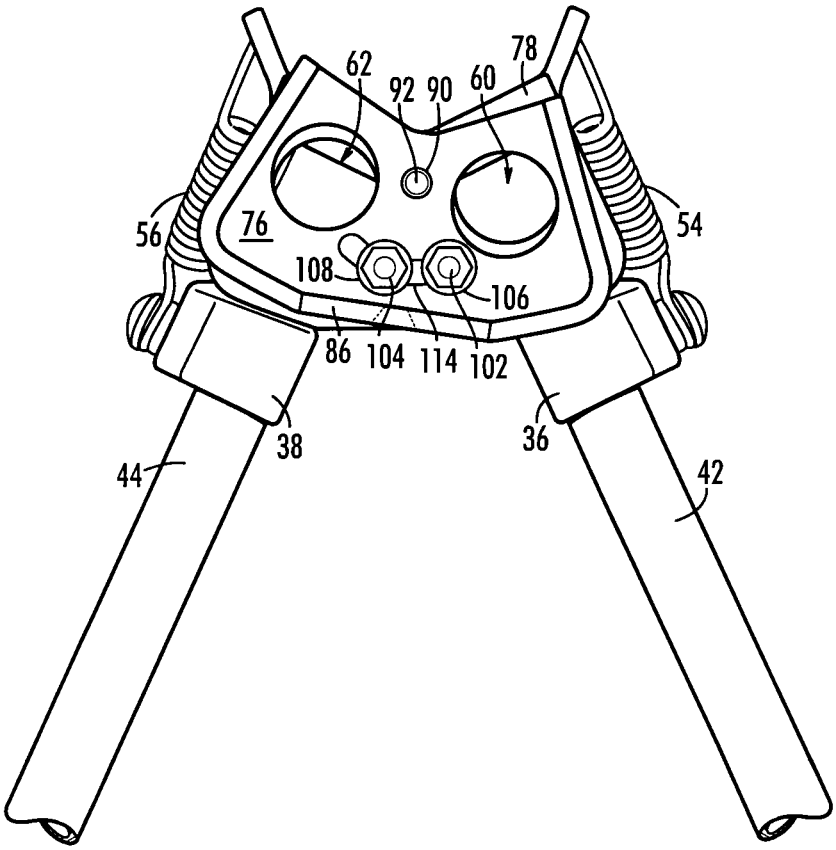
FIG. 12 is a rear view of the bipod of FIG. 11 with both legs in the deployed position and the bipod canted clockwise, according to an embodiment of the invention.
Figure 13:
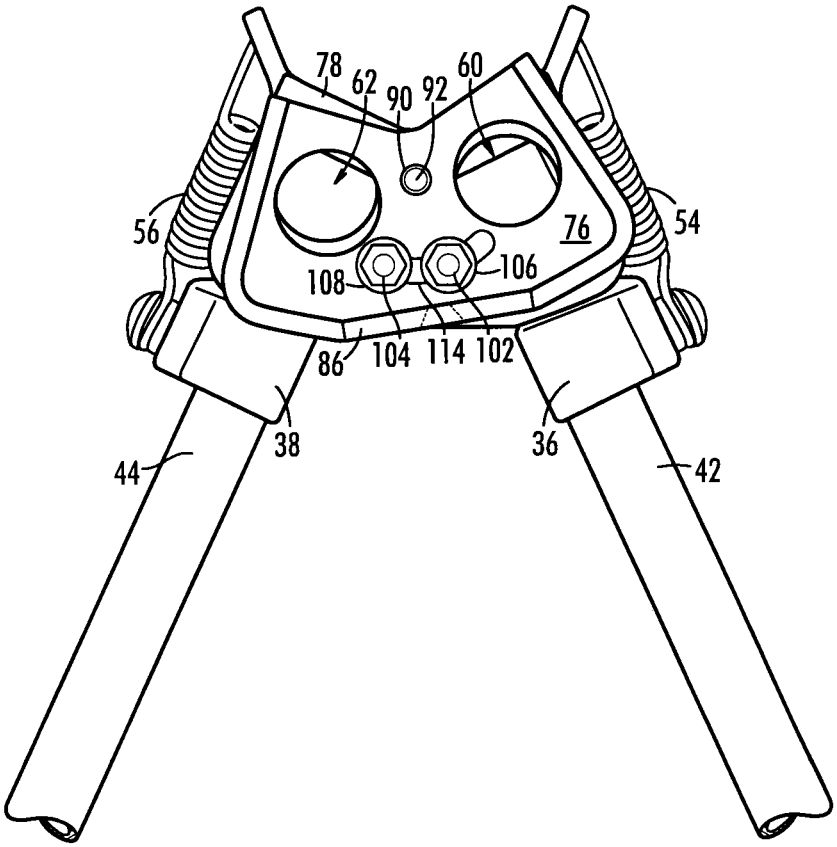
FIG. 13 is a rear view of the bipod of FIG. 11 with both legs in the deployed position and the bipod canted counter-clockwise, according to an embodiment of the invention.

FIGS. 11, 12 and 13 are rear views of bipod 12 with both legs 42, 44, shown in their respective deployed positions and first and second parts 76, 78, of bracket 40 shown in their normal position with respect to each other in FIG. 11, but with second part 78 canted clockwise in FIG. 12 and canted counter-clockwise in FIG. 13. The term canted in this case means second part 78 of bracket 40 has been rotated with respect to first part 76 of bracket 40 about an axis through sleeve 90 in hole 92 in the upper center of first part 76 of bracket 40, typically by plus and minus about 15 to 20 degrees, so that second part 78 which carries the deployed legs 42, 44, can have one leg 42, 44, slightly lower (more vertical) than the other leg 42, 44, and fore-stock, which is carried by first part 76 can be made more or less level when legs 42, 44, are resting on an uneven surface. When legs 42, 44, are on uneven surface, being able to cant legs 42, 44, with respect to stock 10 is an advantage in aiming.

The ability of second part 78 of bracket 40 to be canted with respect to first part 76 is limited by using two screws 102, 104, with washers 106, 108, to hold the two parts 76, 78, together axially but allow second part 78 to rotate about an axis through sleeve 90 through hole 92. Screws 102, 104, act as stops to limit the extent of the rotation. Washers 106, 108, allow screws 102, 104, to hold two parts 76, 78, together without excessive tightening so that first and second parts 76, 78, can be easily rotated with respect to each other. Preferably, washers 106, 108, are spring washers.

The crescent-shaped hole 114 in first part 76 of bracket 40, as seen in FIGS. 11, 12, and 13, defines the length of an arc of common radius with respect to a pivot point, defined by sleeve 90 and has a width equal to the thickness of the screws 102, 104. Both screws 102, 104, are threaded into second part 78 and pass through crescent-shaped hole 114 in first part 76 at that same radius from sleeve 90. However, the arc of crescent-shaped hole 114 is greater than the arcuate distance between screws 102, 104, so second part 78 can be rotated with respect to first part 76 until either screw 102 or 104 reaches its respective end of crescent-shaped hole 114. Screws 102, 104 act as stops to limit canting of second part 78 with respect to first part 76 of stock 10.

The present invention is thus a stock 10 including a bipod 12 where legs 42, 44, are stored internal to fore-stock 16 and optionally a monopod 14 that may be stored against the bottom of butt stock 18. Both deploy by rotation, monopod 14 by rotating its foot 124 away from butt stock 18 and bipod legs 42, 44, by pulling them out of channels 48, 50, in fore-stock 16 to their extended positions and then down into their splayed, deployed positions.

Figure 15A:
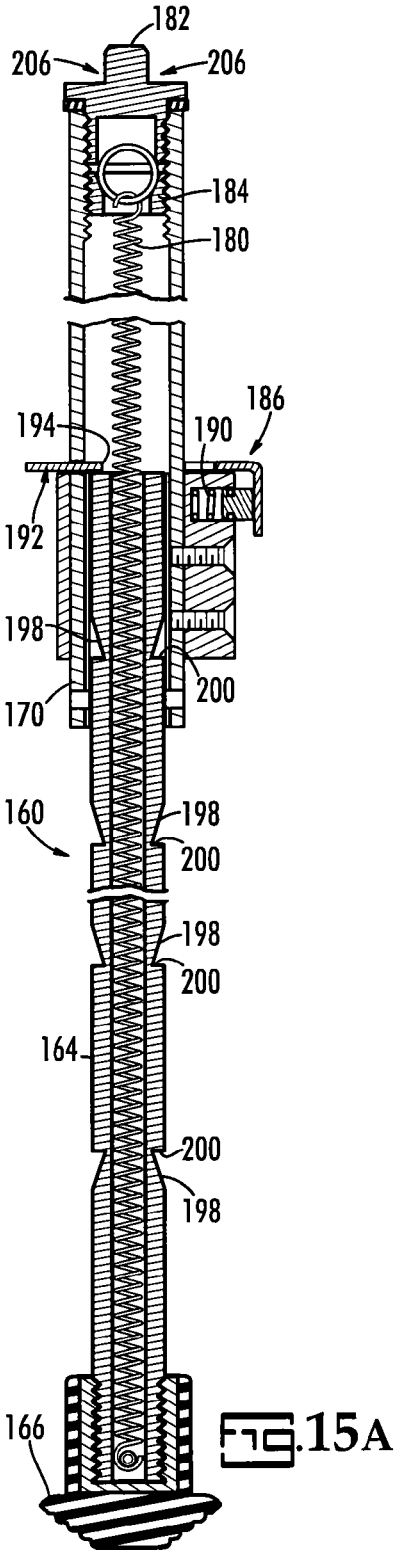
FIGS. 15A and 15B illustrate an alternative bipod leg in the extended configuration (FIG. 15A) and the retracted position (FIG. 15B), according to an embodiment of the invention.
Figure 16:
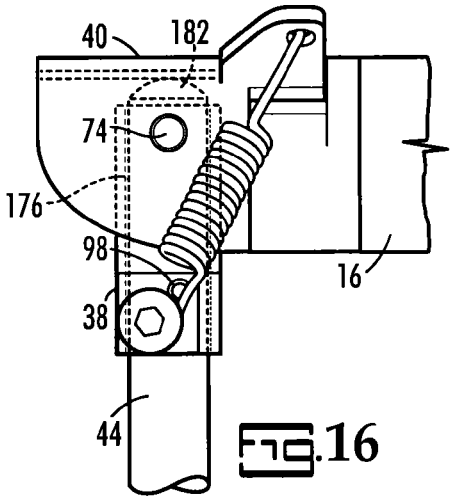
FIG. 16 illustrates a detail of the left side view of the bracket and left leg, according to an embodiment of the invention.
Figure 15B:
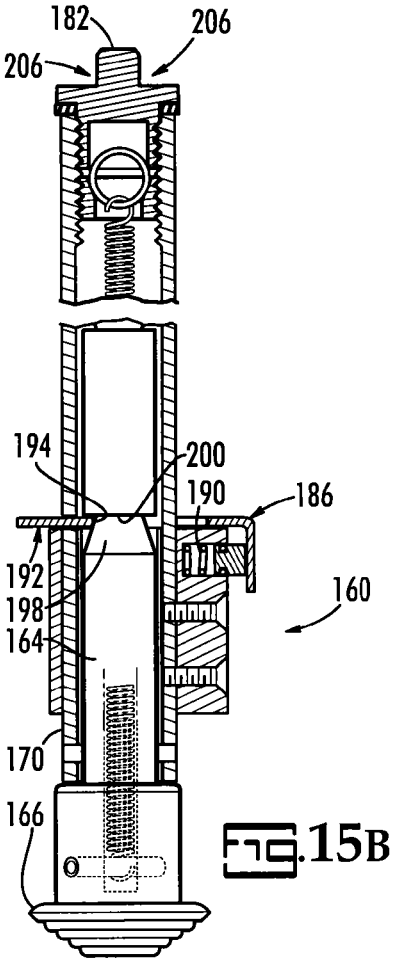

FIGS. 15A and 15B illustrate an alternative leg for the present bipod. Leg 160 is telescoping. In FIG. 15A, leg 160 is fully extended; in FIG. 15B, leg 160 is fully retracted. Leg 160 includes a shaft 164 terminating in a foot 166 and is slidably received inside a tube 170 that is slidable through collar 38 (see FIG. 16) pivotally attached to bracket (not shown in FIGS. 15A and 15B). Collar 38 is preferably lined with a brass sleeve 176 (as seen in FIG. 16) to facilitate movement and minimize wear. Shaft 164 is biased into tube 170 by a spring 180 attached to a threaded plug 184 just below cap 182 at the top of tube 170. To extend shaft 164, the user must pull against the spring force of spring 180.

A spring latch 186 is carried at the lower end of tube 170. Spring latch 186 is biased by latch key spring 190 to insert a key 192 into a hole 94 in the wall of tube 170. Along the length of shaft 164 at intervals are pairs of tapered sections 198 terminating in step sections 200. The lower most pair of sections 198, 200 are reversed in order from the order of the pairs of sections 198, 200 above them. This sequence requires leg 160 to be released by spring latch 186 before it can be pulled from its lowest position. Thereafter, leg 160 can be extended without unlatching, the tapered section 198 gradually pushing key 192 out of hole 194 as shaft 164 moves axially relative to tube 170, but key 192 periodically snapping back into hole 194 when a stepped portion 200 is moved even with hole 194. When released, the shaft 164 of leg 160 will retreat into tube 170 urged by spring 180, but, as a tapered portion 198 on shaft 164 passes by key 192, key 192 will be urged by latch key spring 190 deeper into hole 194 until key 192 hits stepped section 200, which stops movement of shaft 164 as soon as stepped section 200 appears even with hole 194. Pressing on spring latch 186 removes key 192 from hole 194 and thereby allows spring 180 to pull shaft 164 fully into tube 170.

The arrangement of tapered sections 198 and stepped sections 200 enables the user to be able to extend legs 42, 44, to each incremental length using one hand by pulling on legs 42, 44, in one direction, and to retract legs 42, 44, in the opposing direction using one hand to press on spring latch 186.

Cap 182 is configured with cutouts 206 so that the user can stick a screw driver, pick or similar tool into cutout 206 between cap 182 and bracket 40 (see FIG. 16) while unscrewing tube 170 in order to release tube 170 from bracket 40. Threaded plug 184 remains in tube 170 while cap 182 remains with bracket 40. The ability to interchange legs of bipod (and monopod, which is removed from bracket 20 by releasing set screw 148 as shown in FIGS. 14A, 14B) is a particular feature of the present invention in that it allows different legs to be used, such as legs with different style feet or different length adjustments or to replace bipod legs that have become damaged without having to replace the entire bipod.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A firearm for use in firing projectiles, comprising:

(a) a barrel;

(b) a receiver in operative connection with said barrel;

(c) a trigger assembly carried by said receiver, wherein said trigger assembly operatively enables said receiver to fire a projectile through said barrel;

(d) a fore-stock supporting said barrel, said fore-stock having two channels formed therein;

(e) a butt stock attached to said receiver and in spaced relation to said fore-stock;

(f) a bipod having (i) a bracket attached to said fore-stock, (ii) two collars pivotally attached to said bracket, and (iii) two legs and dimensioned to fit within said two channels in said fore-stock when said two legs are in a stored position, said collars securing said legs to said bracket and allowing said two legs to be pulled from said two channels and pivoted to a deployed position wherein said two legs are perpendicular to said barrel and splayed, wherein said bracket has a first part and a second part with a hole through said first and second parts and a sleeve inserted in said first and second parts about which said second part pivots, and with a screw running through said sleeve, said first part being secured to said fore-stock by said screw, said second part being pivotally connected to said first part by said screw running through said sleeve so that, when said second part rotates with respect to said first part, said legs are canted with respect to said fore-stock; and (g) a monopod pivotally attached to said butt stock, wherein said monopod has a foot and a spring connected to said foot and wherein said monopod pivots, biased by said spring, to both a stored and to a deployed position with said foot perpendicular to butt stock and away from a position intermediate to said deployed position and said stored position.

2. The firearm as recited in claim 1, wherein said butt stock has a hand grip having a hollow portion formed therein and wherein said foot of said monopod pivots into said hollow portion.

3. The firearm as recited in claim 1, wherein said monopod has a length and said length is adjustable.

4. The firearm as recited in claim 1, wherein said bracket permits said legs of said bipod to be canted with respect to said fore-stock.

5. The firearm as recited in claim 1, wherein each leg of said legs of said bipod further comprises (a) a shaft;

(b) a tube with a hole formed therein, said shaft slidably carried within a tube;

(c) a spring urging said shaft into said tube;

(d) a threaded plug in the end of said tube, said spring secured to said threaded plug and to said shaft; and (e) a latch carried by said tube and having a key dimensioned to fit within said hole in said tube so that said latch permits and prevents movement of said shaft with respect to said tube.

6. The firearm as recited in claim 5, wherein said shaft is formed to have pairs of tapered sections and stepped sections, said tapered sections permitting said key to enter deeper into said hole so that said stepped sections stop movement of said shaft with respect to said tube in one direction but not when moving in an opposing direction.

7. The firearm as recited in claim 5, wherein said latch further comprises a latch key spring urging said key into said hole.

8. A firearm for use in firing projectiles, comprising:

(a) a barrel;

(b) a receiver in operative connection with said barrel;

(c) a trigger assembly carried by said receiver, wherein said trigger assembly operatively enables said receiver to fire a projectile through said barrel;

(d) a fore-stock supporting said barrel, said fore-stock having two channels formed therein;

(e) a butt stock attached to said receiver and in spaced relation to said fore-stock; and (f) a bipod having (i) a bracket having a first part and a second part with a hole through said first and second parts and a sleeve inserted in said first and second parts about which said second part pivots, and with a screw running through said sleeve to secure said first and second parts to said fore-stock, said first part being pivotally attached thereby to said second part, (ii) two collars pivotally attached to said second part of said bracket, and (iii) two legs and dimensioned to fit within said two channels in said fore-stock when said two legs are in a stored position, said collars securing said legs to said bracket and allowing said two legs to be pulled from said two channels and pivoted to a deployed position wherein said two legs are perpendicular to said barrel and splayed, wherein said legs of said bipod are pivotable with respect to said fore-stock.

9. The firearm as recited in claim 8, wherein each leg of said legs of said bipod further comprises (a) a shaft;

(b) a tube with a hole formed therein, said shaft slidably carried within a tube;

(c) a spring urging said shaft into said tube;

(d) a threaded plug in the end of said tube, said spring secured to said threaded plug and to said shaft; and (e) a latch carried by said tube and having a key dimensioned to fit within said hole in said tube so that said latch permits and prevents movement of said shaft with respect to said tube.

10. The firearm as recited in claim 9, wherein said shaft is formed to have pairs of tapered sections and stepped sections, said tapered sections permitting said key to enter deeper into said hole so that said stepped sections stop movement of said shaft with respect to said tube, said tapered sections permitting said key to enter deeper into said hole so that said stepped sections stop movement of said shaft with respect to said tube in one direction but not when moving in an opposing direction.

11. The firearm as recited in claim 9, wherein said latch further comprises a latch key spring urging said key into said hole.

12. A firearm for use in firing projectiles, comprising:

(a) a barrel;

(b) a receiver in operative connection with said barrel;

(c) a trigger assembly carried by said receiver, wherein said trigger assembly operatively enables said receiver to fire a projectile through said barrel;

(d) a fore-stock supporting said barrel, said fore-stock having two channels formed therein;

(e) a butt stock attached to said receiver and in spaced relation to said fore-stock;

(f) a bipod having (i) a bracket attached to said fore-stock, said bracket having a first part attached to said fore-stock, and a second part pivotally attached to said first part, and a hole formed through said first and said second parts of said bracket with a sleeve in said hole running from said second part to said first part and a screw in said sleeve running from said second part through said first part and into said forestock, (ii) two collars pivotally attached to said second part of said bracket, and (iii) two legs and dimensioned to fit within said two channels in said fore-stock, said two legs being in a stored position when said two legs are inserted into said two channels, said collars securing said legs to said bracket and allowing said two legs to be pulled from said two channels and pivoted to an in-use position in which said two legs are perpendicular to said barrel and splayed; and (g) a monopod pivotably carried by said butt stock, said monopod having a deployed position and a stored position, said monopod including a spring biasing said monopod to said deployed position and said stored position and biasing said monopod away from any position intermediate said deployed position and said stored position.

13. The firearm as recited in claim 12, wherein said monopod has a foot and wherein said monopod pivots about an axis perpendicular to said barrel to a stored position with said foot closer to said receiver and a deployed position with said foot perpendicular to butt stock.

14. The firearm as recited in claim 12, wherein said butt stock has a hand grip having a hollow portion formed therein and wherein said foot of said monopod pivots into said hollow portion.

15. The firearm as recited in claim 12, wherein said monopod has a length and said length is adjustable.

16. The firearm as recited in claim 12, wherein each leg of said legs of said bipod further comprises (a) a shaft;

(b) a tube with a hole formed therein, said shaft slidably carried within a tube, said tube having interior threads;

(c) a spring urging said shaft into said tube;

(d) a threaded plug in the end of said tube, said spring secured to said threaded plug and to said shaft; and (e) a latch carried by said tube and having a key dimensioned to fit within said hole in said tube so that said latch permits and prevents movement of said shaft with respect to said tube.

17. The firearm as recited in claim 16, wherein said shaft is formed to have pairs of tapered sections and stepped sections, said tapered sections permitting said key to enter deeper into said hole so that said stepped sections stop movement of said shaft with respect to said tube, said tapered sections permitting said key to enter deeper into said hole so that said stepped sections stop movement of said shaft with respect to said tube in one direction but not when moving in an opposing direction.

18. The firearm as recited in claim 16, wherein said latch further comprises a latch key spring urging said key into said hole.

19. The firearm as recited in claim 16, wherein each leg further comprises a threaded cap on the end of said tube, said cap having a diameter larger than said hole in said collar and smaller than said channel.

* * * * *